US006589088B1

(12) United States Patent
Maness

(10) Patent No.: US 6,589,088 B1
(45) Date of Patent: Jul. 8, 2003

(54) LOW PROFILE LIFE VEST

(75) Inventor: Sam G. Maness, Apollo Beach, FL (US)

(73) Assignee: Lifesaving Systems Corporation, Apollo Beach, FL (US)

( * ) Notice: Subject to any disclaimer, the term of this patent is extended or adjusted under 35 U.S.C. 154(b) by 0 days.

(21) Appl. No.: 10/035,992

(22) Filed: Dec. 31, 2001

(51) Int. Cl.[7] ..... B63C 9/125
(52) U.S. Cl. ..... 441/106; 441/118
(58) Field of Search ..... 441/88, 106, 114–119

(56) References Cited

U.S. PATENT DOCUMENTS 1,487,923 A 3/1924 Vilbiss
3,681,801 A * 8/1972 Bel ..... 441/118
4,297,758 A 11/1981 Moran
4,925,419 A 5/1990 Susanna
5,567,191 A 10/1996 Gordon
5,692,933 A 12/1997 Bradley et al.

FOREIGN PATENT DOCUMENTS

GB 941150 * 11/1963

* cited by examiner

*Primary Examiner*—Sherman Basinger
(74) *Attorney, Agent, or Firm*—Pettis & Van Royen, PA

(57) ABSTRACT

A low-profile life vest particularly suitable for use by pilots having helmets with integrated display and sighting systems. The life vest comprises an inflatable bladder and a generally U-shaped cover that houses the bladder in the deflated condition so that the bladder is as compact as possible. When the inflatable vest is activated, the bladder must have a means for egress or expansion through the cover, conveniently a zippered opening that extends longitudinally along the life vest. On the portion of the life vest that passes over the pilot's shoulder, the zippered opening is formed on one of the sides of the life vest and is spaced apart from its peripheral edge.

3 Claims, 6 Drawing Sheets

LOW PROFILE LIFE VEST

BACKGROUND OF THE INVENTION

1. Field of the Invention

The present invention relates generally to inflatable life preservers, and is directed particularly to life vests worn by pilots using helmets with an integrated display and sighting system.

2. Description of the Prior Art

For protection of the pilots and crew, governmental regulations require that life preservers be available in aircraft, including those aircraft used in combat. Vests and preservers of many types have been disclosed in the prior art. Most vests, including those used by pilots, comprise a bladder that is deflated and compressed into a case. The case has a zipper extending about its periphery that opens under the pressure of the expanding bladder, when the bladder is inflated. The portion of these vests that lies across the shoulders is thick, so that frequently when the pilot turns his head to acquire a target the vest conflicts with the pilots helmet. This often causes the helmet to twist on the pilots head preventing the pilot from properly locking on to the target when using the integrated display and sighting system.

Notwithstanding the existence of prior art inflatable vests and preservers, there is a need for a low profile life vest that will not conflict with a pilot's helmet.

SUMMARY OF THE INVENTION

The present invention relates to a life vest, particularly a life vest worn by pilots wearing a helmet having an integrated display and sighting system for combat targeting. Most simply stated, the life vest of this invention comprises an inflatable bladder and a generally U-shaped cover that houses the bladder in the deflated condition so that the bladder is as compact as possible.

When the life vest is activated so that the bladder is filled with a gas, the bladder must have a means for egress, or expansion, through the cover, as the bladder when expanded is much larger than the cover. The cover comprises a first side, a second side, a peripheral edge a first leg and a second leg,. Each leg further comprises a chest portion, a shoulder portion and a neck portion. The means for egress through the cover extends longitudinally along the chest portion, shoulder portion, and neck portion of each of the first and second legs to permit proper expansion of the bladder. Along the shoulder portion, the means for permitting egress through the cover lies within one of the first and second sides of the cover and is spaced apart from the peripheral edge of the cover.

Means for inflating the bladder from a deflated condition to an inflated condition is attached to the interior of the cover of the life vest and is connected in fluid flow relationship with the bladder.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF A PREFERRED EMBODIMENT

Figure 5:
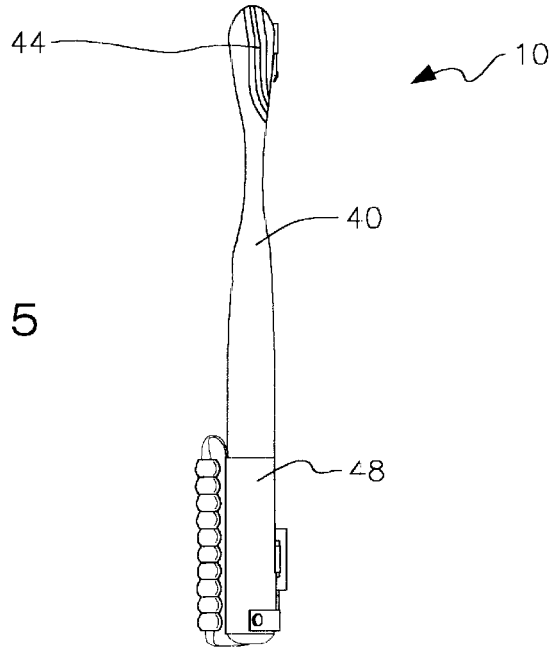
FIG. 5 is a right side elevational view of the invention of FIG. 1.
Figure 6:
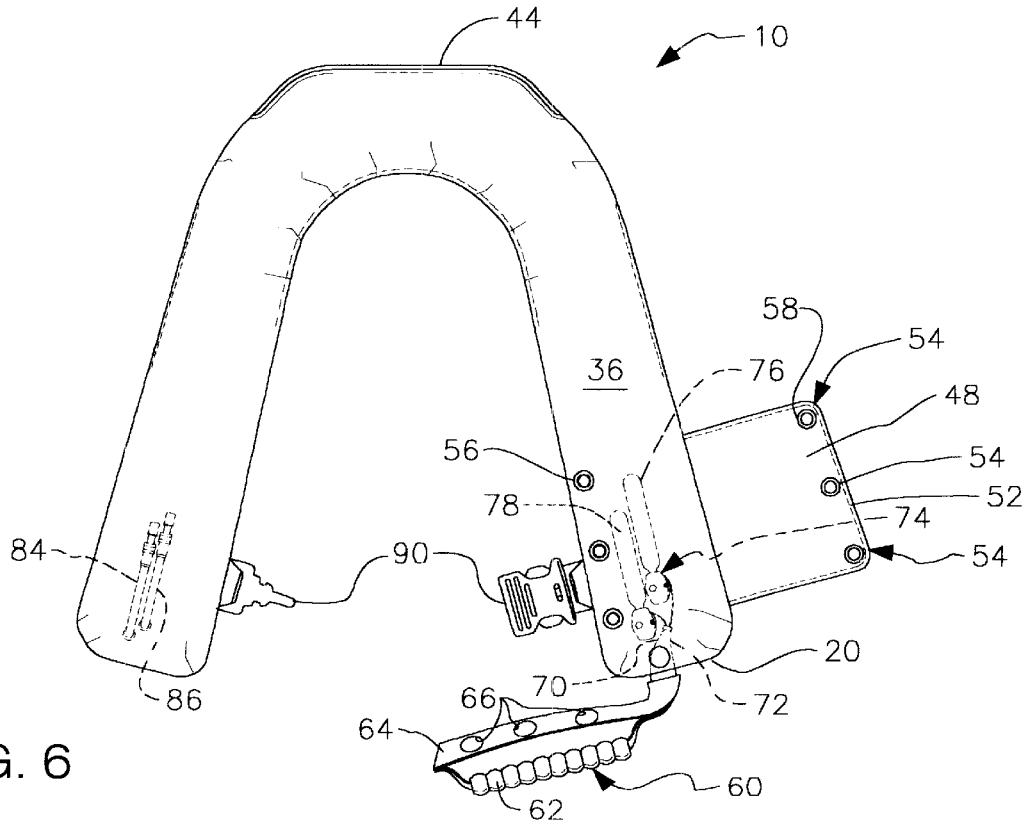
FIG. 6 is a front elevational view of the invention of FIG. 1 illustrating pulling the lanyard and open the flap.
Figure 7:
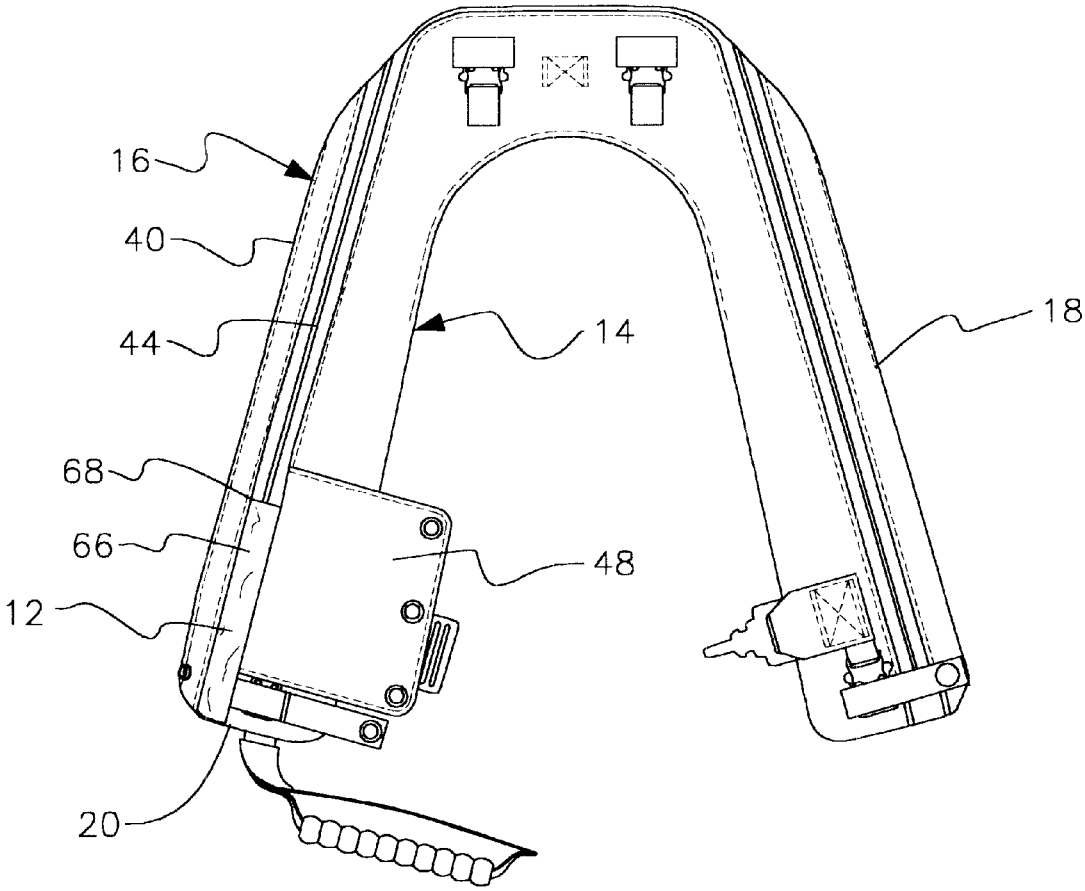
FIG. 7 is a rear elevational view of the invention of FIG. 1, illustrating the aperture in the cover.
Figure 8:
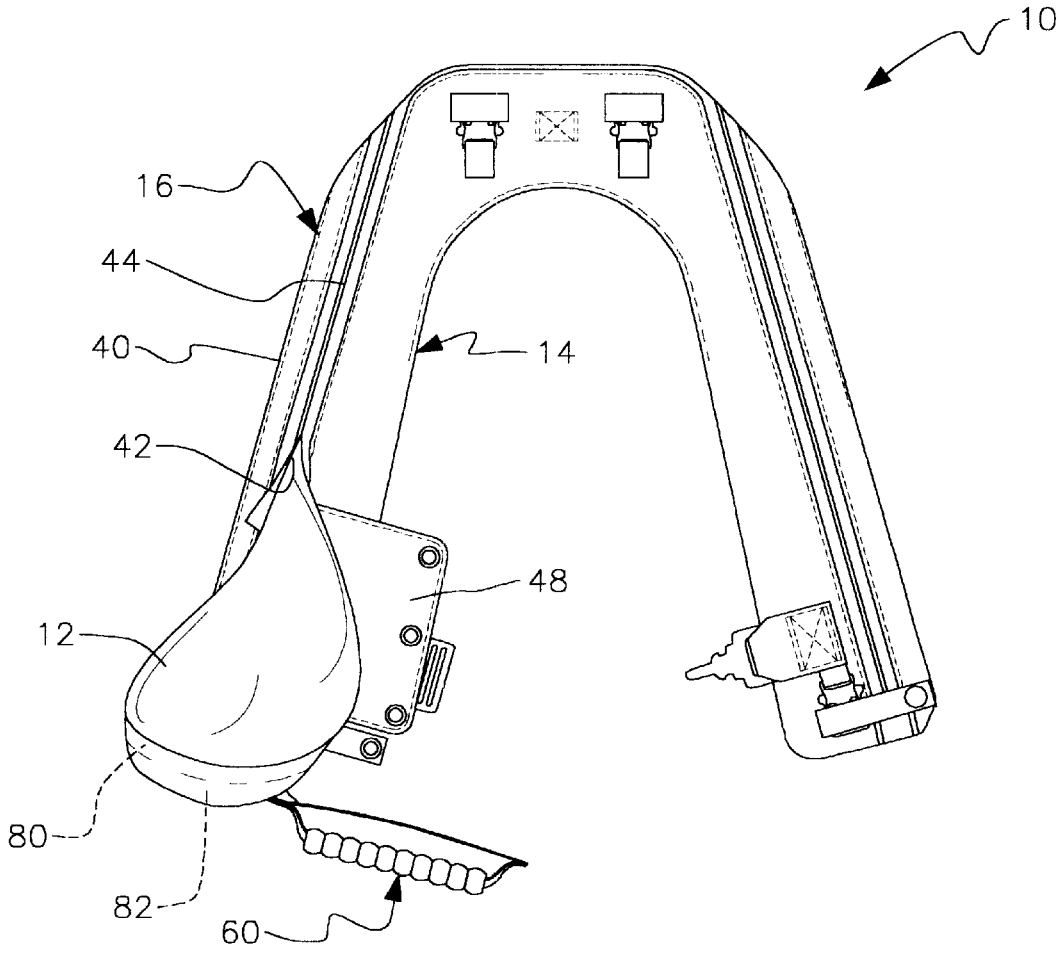
FIG. 8 is a rear elevational view of the invention of FIG. 1, illustrating the expansion of the bladder through the aperture in the cover and separation of the zipper.

A preferred embodiment for the inflatable life vest of this invention is illustrated in the drawing FIGS. 1–9 in which the life vest is generally indicated as 10. Referring first to FIG. 7, it can be seen that the life vest 10 comprises a bladder shown generally as 12 and a cover shown generally as 14.

Figure 1:
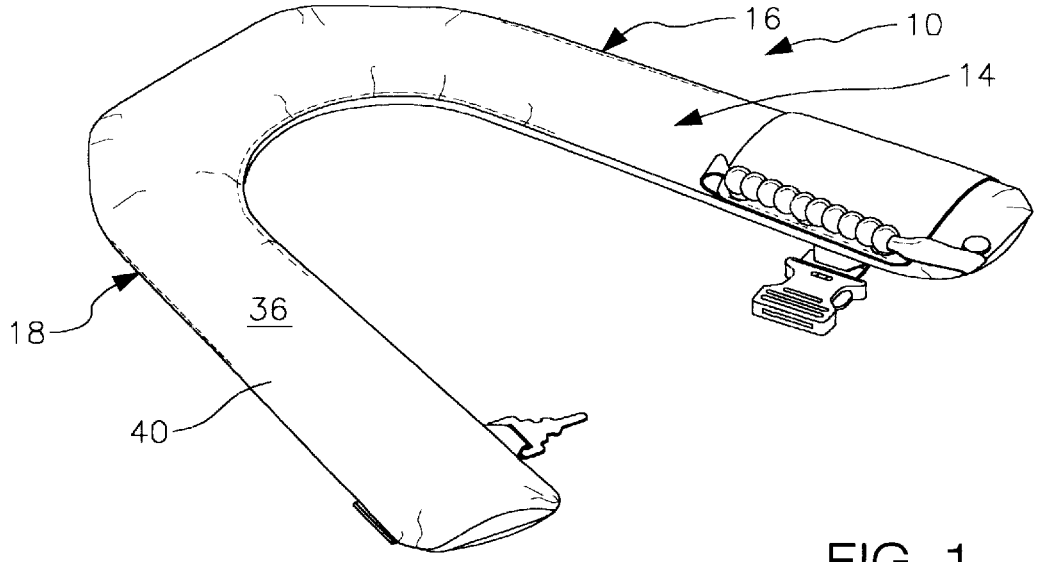
FIG. 1 is a front isometric view of the inflatable life vest of this invention.
Figure 3:
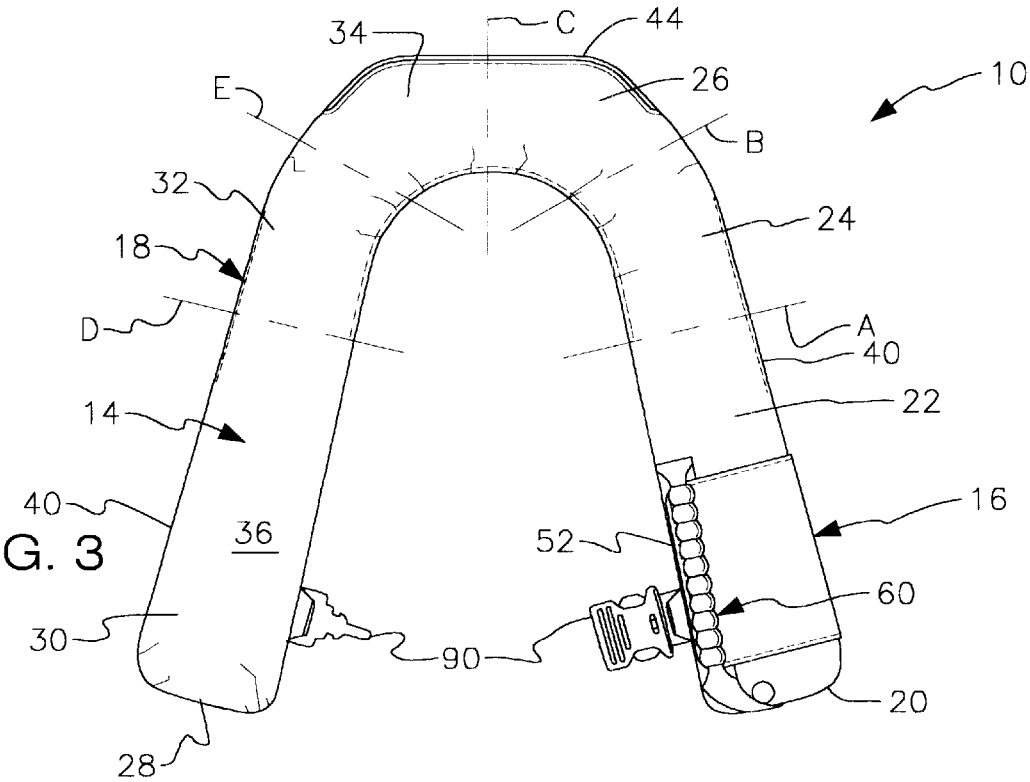
FIG. 3 is a front elevational view of the invention of FIG. 1.

The cover 14 is defined as that portion of the life vest that is in contact with and encloses the bladder 12 therein. As seen in FIG. 1 and FIG. 3, the cover is generally U-shaped and has a first leg shown generally as 16 and a second leg shown generally as 18. The first leg 16 comprises: a first end 20; a chest portion 22, which generally defines the portion of the first leg 16 that rests upon the pilot's chest and extends from the first end 20 to the line A; a shoulder portion 24, which generally defines the portion of the first leg 16 that lies across the pilot's left shoulder and extends between the line A and the line B; and a neck portion 26, which generally lies behind the neck of the pilot and extends from the line B to the line C. The second leg 18 has a similar composition in that it comprises: a first end 28; a chest portion 30, which generally defines the portion of the second leg 18 that rests upon the pilot's chest and extends from the first end 28 to the line D; a shoulder portion 32, which generally defines the portion of the second leg 18 that lies across the pilot's right shoulder, and extends between the line D and the line E; and a neck portion 34, which generally lies behind the neck of the pilot and extends from the line E to the line C. The lines D and E can also be seen clearly in FIG. 8.

Figure 2:
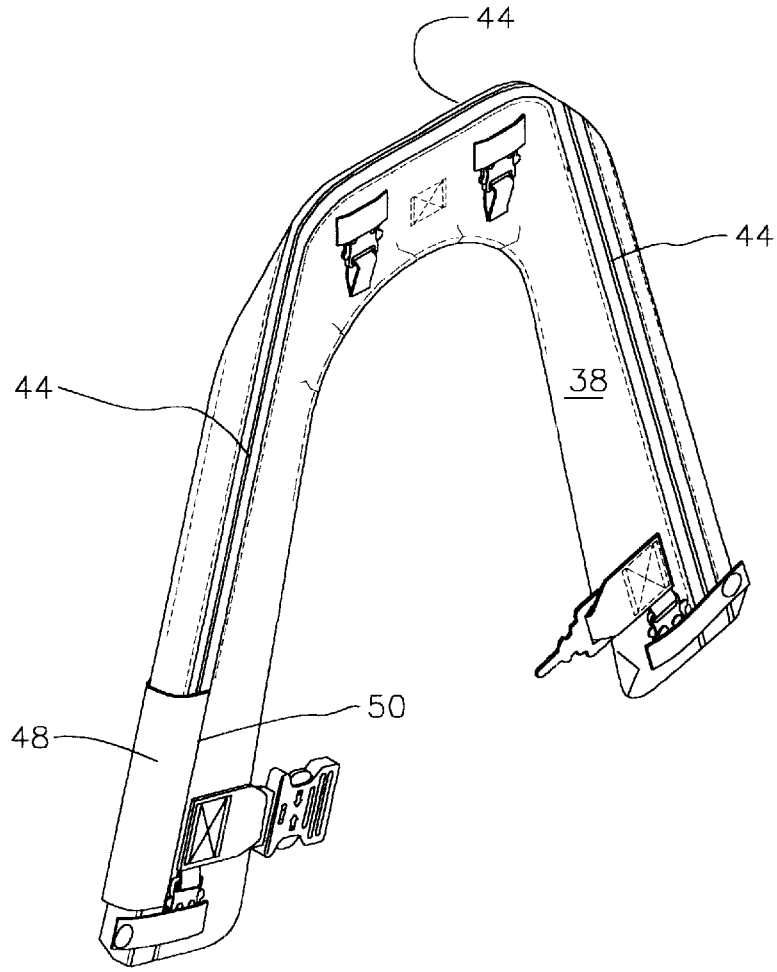
FIG. 2 is back isometric view of the invention of FIG. 1.
Figure 4:
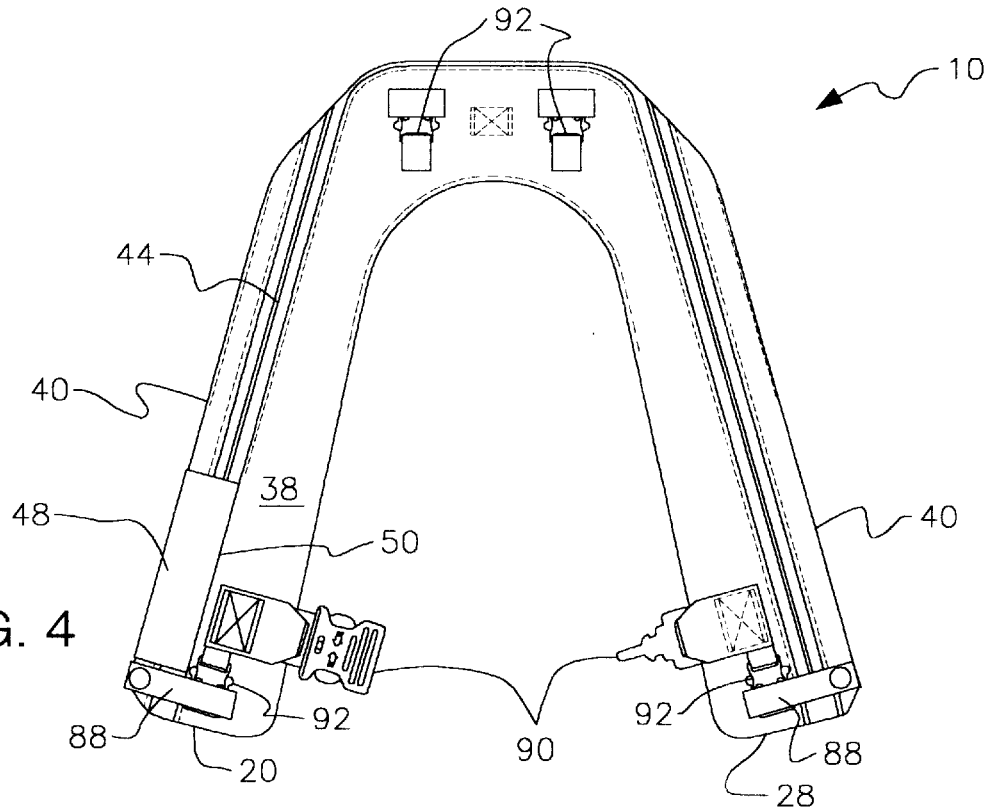
FIG. 4 is a rear elevational view of the invention of FIG. 1.

The cover 14 has a first side 36, as seen in FIG. 1, a second side 38, as seen in FIG. 2, and a peripheral edge 40, as seen in FIG. 5. The cover 14 maintains the bladder 12 in a compressed condition while the bladder is deflated so that the life vest 10 provides the minimum amount of interference with the movements of the pilot. In order for the bladder 12 to inflate it must be releasable from the cover 14. Therefore, the cover 14 has a means for permitting egress through the cover so the bladder can expand outwardly therethrough. In a preferred embodiment, the means for permitting egress through the cover comprises an opening 42 that extends longitudinally along the legs 16 and 18 of the vest 10. In a preferred embodiment, this opening 42 is closed by a zipper 44 that is openable throughout its length when the bladder applies pressure on the zipper 44. In the preferred embodiment illustrated in the drawing FIGS. 1–9, the zipper extends longitudinally along the chest portion 22, the shoulder portion 24, and the neck portion 26 of the first leg 16, and then along the neck portion 34, shoulder portion 32, and the chest portion 30 of the second leg 18.

Figure 9:
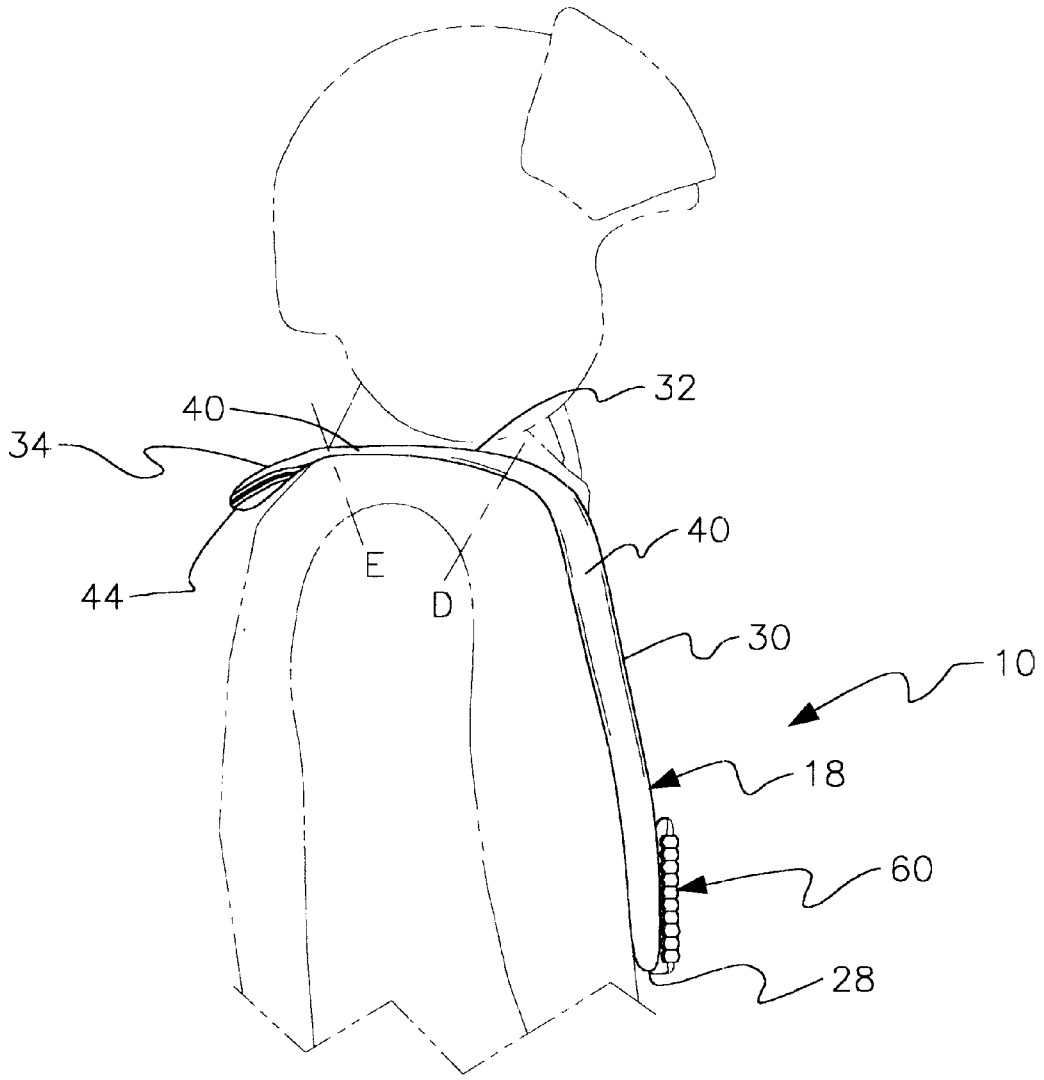
FIG. 9 is a right side elevational view illustrating the invention of FIG. 1 being worn by a pilot wearing a helmet.

To reduce the risk of a conflict between the life vest 10 and a helmet worn by a pilot, shown In phantom in FIG. 9, it is essential that the shoulder portions 24 and 32 of the life vest 10 be as thin as possible as they lay across the shoulders of the pilot. If the zipper 44 were to lie along the peripheral edge 40 of the shoulder portions 24 and 32, it would dictate the thickness of the shoulder portions of the life vest. Therefore, to minimize the thickness of the shoulder portions of the life vest, the opening 42 is formed in either the first side 36 or the second side 38 of the cover and the zipper 44 is attached to the opening 42 so that the zipper 44 lies within the first side 36 or the second side 38 throughout the shoulder portion and the zipper lies flat, or parallel to the first side 36 or the second side 38 as seen in FIG. 4 and 5, across the shoulders. In the preferred embodiment illustrated in the drawing figures, the zipper 44 is attached to the second side 38, which is the side that faces inwardly toward the pilot This is preferred as it reduces the possibility of the zipper 44 being caught on other equipment worn by the pilot or on equipment installed in an aircraft. In order for the vest to lie flat around the neck of the pilot, the opening 42 passes through at least a portion of the peripheral edge 40 of the neck portions 26 and 34 with the zipper 44 being located along at least a portion of the peripheral edge 40, as seen in FIGS. 2–5.

The cover 14 further comprises a flap 48 that is attached to the cover proximal the first end 20 of the first leg 16. The flap 48 has a first side 50 that is attached to the second side 38 of the cover 14, as seen in FIG. 4. The second side 52 of the flap 48 is removably attached to the first side 36, as seen in FIG. 3. In a preferred embodiment at least one snap 54 is used to attach the flap 48 to the first side 36, as seen in FIG. 6. The snap 54 is comprised of a male part 56 and a female part 58. A lanyard 60 extends outwardly from the first end 20, which comprises a gripper 62 and a tab 64. The tab 64 has at least one hole 66 therethrough that is sized and configured to receive the male part 56 of the snap 54 therethrough. Therefore, when the lanyard is placed over the male part 56 of the snap 54 and the flap 48 is closed by attaching the female part 58 to the male part 56, the lanyard 60 is held along the chest portion 22 of the first leg 16. In a preferred embodiment, to ensure that the flap remains in a closed position, three snaps 54 and additional holes 66 are provided. When the lanyard is pulled by the pilot the snaps 54 are opened and the flap 48 is also opened, as shown in FIGS. 6 and 7.

The flap 48 covers an aperture 66 through the cover 14 that extends from the first end 68 of the zipper 44 to a point proximal the first end 20 of the first leg 16 as seen in FIG. 7. The aperture 66 provides easy early expansion of the bladder 12 to provide increased force against the first end 68 of the zipper 44 so that the zipper 44 opens quickly in response to the inflation of the bladder 12.

As seen in FIG. 6, the lanyard 60 is attached by cords 70 and 72 to a means for inflating the bladder, conveniently an inflator comprising a pair of gas cylinders 76 and 78 and a means for activating them. In a preferred embodiment, the bladder 12 comprises dual chambers 80 and 82 with gas cylinders 76 and 78 being attached in fluid flow communication with a respective one of the chambers 80 and 82. By pulling the lanyard, an actuator attached to the gas cylinders punctures them, thereby inflating both chambers of the bladder. Inflators are well-known in the art, and any inflator that is suitable for the purpose may be used, for example Part No. 840AMLS manufactured by the Halkey-Roberts company would be satisfactory. In addition, the life vest 10 has a pair of oral inflators 84 and 86 that are attached in fluid flow communication with a corresponding chamber for emergency inflation thereof. The gas cylinders contain enough gas to inflate their respective chambers so that the combined volume of the chambers provide adequate flotation. If one of the chambers fails to inflate or is punctured during ejection from an aircraft, the appropriate oral inflator is used to fully inflate the undamaged chamber to create sufficient volume to provide adequate flotation.

A protective strap 88 is attached proximal to the first ends 20 and 28 of each leg to help prevent inadvertent opening of the zipper 44. The life vest 10 also comprises a clasp 90 that keeps the legs 16 and 18 proximal to one another while the life vest 10 is worn by the pilot or crew. One-half of a number of clips and clasps 92 are attached to the second side 38, which are attachable to the corresponding other half of the clip or clasp that is attached to a harness (not shown) worn by the pilot, to keep the life vest properly positioned on the harness and thus on the pilot.

In a preferred embodiment, the cover 14 is made from a high temperature synthetic material similar to NOMEX®, a registered trademark of E.I. du Pont de Nemours & Co. for synthetic fiber for protective clothing. A nylon lining is added to the high temperature synthetic material. The bladder 12 is comprised of a urethane coated nylon. The hardware may be constructed from synthetic resins or suitable metals.

Having thus set forth a preferred construction for the current invention, it is to be remembered that this is but one preferred embodiment. Attention is now invited to a description of the use of the inflatable life vest 10. When the pilot's flight plan calls for an overwater flight, the pilot will place the life vest 10 over his or her head and attach clasp 90 and then attach clasps 92 to an equipment harness. The life vest 10 should fit snugly to prevent unwarranted movement of the life vest or conflict with the pilot's equipment. The profile of the shoulder portions 24 and 32 of the life vest 10, as seen in FIG. 9, are thin which reduces the risk of any conflict with the pilot's helmet. This enables the pilot to use his/her integrated display and sighting system without fear that the integrated display and sighting system will be moved off target by the helmet dragging or catching on the life vest 10.

In an emergency situation, when the pilot finds himself/herself in the water, he/she will grasp the grip 62 of the lanyard 60 and pull it downwardly to release the flap and activate the gas cylinders. The bladder 12 will immediately expand through the aperture 66 applying pressure on the first end 68 of the zipper 44 so that the zipper 44 easily opens down its longitudinal length as the bladder 12 continues to expand. If one of the chambers 80 or 82 fail to fill, the pilot will either fill that unexpanded chamber through the oral inflator or will expand the chamber already filled by the inflator mechanism until it reaches its maximum size for maximum flotation.

While the foregoing describes a particularly preferred embodiment of the present invention, it is to be understood that numerous variations and modifications of the structure will occur to those skilled in the art. Accordingly, the foregoing description is to be considered illustrative only of the principles of this invention and is not to be considered limitative thereof, the scope of the invention being determined solely by the claims appended hereto.

What is claimed is:

1. An inflatable life vest comprising:

a bladder being inflatable from a deflated condition to an inflated condition;

a generally U-shaped cover housing said bladder in said deflated condition, said cover having a first side, a second side and a peripheral edge, said cover further being defined as having a first leg and a second leg, each leg having, a first end, a chest portion, a shoulder portion, and a neck portion;

said cover having an opening therethrough such that said bladder is expandable outwardly through said opening, said opening being openable and closeable by a zipper, said opening through said cover being spaced apart from said peripheral edge and extending longitudinally within said chest portion and said shoulder portion of one of said first and second sides of said first and second legs, and extending along at least a part of said peripheral edge of said neck portion of said first and second legs, and means for inflating said bladder from said deflated condition to said inflated condition connected in fluid flow relationship to said bladder.

2. An inflatable life vest comprising:

a bladder being inflatable from a deflated condition to an inflated condition;

a generally U-shaped cover housing said bladder in said deflated condition, said cover having a first side, a second side and a peripheral edge, said cover further being defined as having a first leg and a second leg, each leg having, a first end, a chest portion, a shoulder portion, and a neck portion;

said cover having an opening therethrough such that said bladder is expandable outwardly through said opening, said opening being openable and closeable by a zipper;

said zipper having a first end that lies proximal said first end of said first leg;

said cover further comprising a longitudinally extending aperture therethrough extending intermediate said first end of said zipper for permitting egress through said cover and said first end of said first leg;

a flap having opposing longitudinally extending first and second sides, said first side being attached to said cover proximal said aperture and said second side being removably attachable to said cover such that said flap covers said aperture; and means for inflating said bladder from said deflated condition to said inflated condition connected in fluid flow relationship to said bladder, a lanyard attached thereto for activating said means for inflating said bladder by releasing an inflating gas, said lanyard comprising a tab having at least one hole therethrough, said second side of said flap being secured to said cover by at least one snap, said snap having a male portion and a female portion, said hole in said tab being sized to receive the male portion of said snap therethrough, such that when said snap is closed said tab is captured therebetween.

3. An inflatable life vest comprising:

a bladder being inflatable from a deflated condition to an inflated condition;

a generally U-shaped cover housing said bladder in said deflated condition, said cover having a first side, a second side, peripheral edge, a first leg and a second leg, each leg having, a first end, a chest portion, a shoulder portion, and a neck portion;

said cover having a opening extending longitudinally within one of said first and second sides of said chest portions and said shoulder portions and extending along at least a part of said peripheral edge of said neck portions of said first and second legs;

a zipper attached to said opening such that said opening is closable and openable;

said zipper having a first end that lies proximal said first end of said first leg; said cover further comprising a longitudinally extending aperture therethrough extending intermediate said first end of said zipper and said first end of said first leg;

a flap having opposing longitudinally extending first and second sides, said first side being attached to said cover proximal said aperture and said second side being removably attachable to said cover such that said flap covers said aperture;

an inflator connected in fluid flow relationship to said bladder; and a lanyard attached to said inflator for activating said inflator, said lanyard comprising a tab having at least one hole therethrough, said second side of said flap being secured to said cover by at least one snap, said snap having a male portion and a female portion, said hole in said tab being sized to receive the male portion of said snap therethrough, such that when said snap is closed said tab is captured therebetween.

* * * * *

UNITED STATES PATENT AND TRADEMARK OFFICE

CERTIFICATE OF CORRECTION

PATENT NO. : 6,589,088 B1
DATED : July 8, 2003
INVENTOR(S) : Maness

It is certified that error appears in the above-identified patent and that said Letters Patent is hereby corrected as shown below:

Column 6,
Line 18, after “a second side,” and prior to “peripheral edge,” insert: -- a --.

Signed and Sealed this

Seventh Day of October, 2003

JAMES E. ROGAN
*Director of the United States Patent and Trademark Office*